US005584743A

United States Patent [19]

Beaulieu

[11] Patent Number: 5,584,743

[45] Date of Patent: Dec. 17, 1996

[54] STEERABLE TOY ROAD SCRAPER

[76] Inventor: Gérald Beaulieu, 11, rue St-François, Mercier, Québec, Canada, J6R 2L1

[21] Appl. No.: 556,651

[22] Filed: Nov. 13, 1995

[51] Int. Cl.[6] ..... A63H 17/14; A63H 33/30; A63H 33/02

[52] U.S. Cl. ..... 446/427; 446/424; 446/450

[58] Field of Search ..... 446/427, 428, 446/429, 425, 426, 450, 460, 465, 468, 470

[56] References Cited

U.S. PATENT DOCUMENTS

| | | | |
|---|---|---|---|
| 2,563,974 | 9/1951 | Thierry | 446/425 |
| 3,691,681 | 9/1972 | Gagnon | 446/425 |
| 3,703,785 | 11/1972 | Pfeilsticker et al. | 446/427 |
| 3,707,054 | 12/1972 | Pfeilsticker | 446/427 |
| 3,757,464 | 9/1973 | Gagnon | 446/427 |
| 4,007,646 | 2/1977 | DeJonge | 446/450 X |
| 4,020,587 | 5/1977 | Cuhel | 446/427 |
| 4,366,645 | 1/1983 | Crain et al. | 446/460 X |

FOREIGN PATENT DOCUMENTS

| | | | |
|---|---|---|---|
| 679576 | 2/1964 | Canada | 446/427 |
| 895989 | 3/1972 | Canada | 446/425 |
| 616141 | 1/1927 | France | 446/454 |
| 79870 | 12/1950 | Poland | 446/454 |
| 2248191 | 1/1992 | United Kingdom | 446/463 |

*Primary Examiner*—Robert A. Hafer
*Assistant Examiner*—D. Neal Muir
*Attorney, Agent, or Firm*—François Martineau

[57] ABSTRACT

The present invention relates to a toy road scraper having three blade members which are vertically movable between a first and a second limit position. The movement of the blade members is controlled through the instrumentality of cables slidingly engaging flexible sheathings. Each blade member is connected to one such cable, the latter being also connected to a control panel having levers for imparting linear displacements to the cables. The linear displacement of a cable results in a corresponding blade member moving from its first to its second limit position, or vice-versa. Two directional cables are connected to the front pivotable wheels and to directional handles on the control panel for steering the toy road scraper. The control panel is positioned at the rear end of the toy road scraper and at such a height to allow a child using it to stand up, walk and have unlimited access to the controls on the control panel.

5 Claims, 5 Drawing Sheets

66
68
70
72
78
48
80
76
74
20a
116
102
118
G
36
26
160
28
158
148
140
154
166
30
24
22
32
20b
60
58
62
56
92
88
90
9
10
11

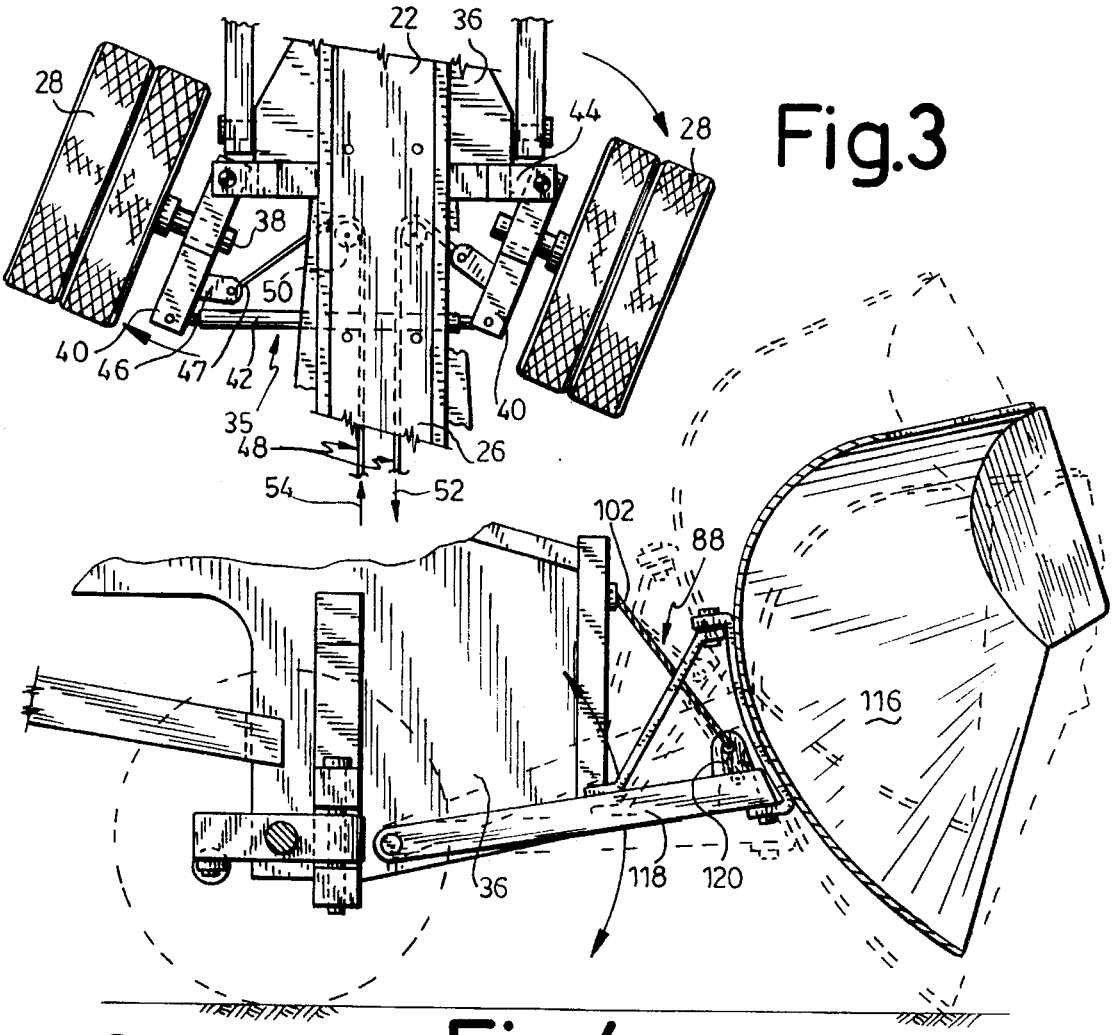
Fig.3
Fig.4
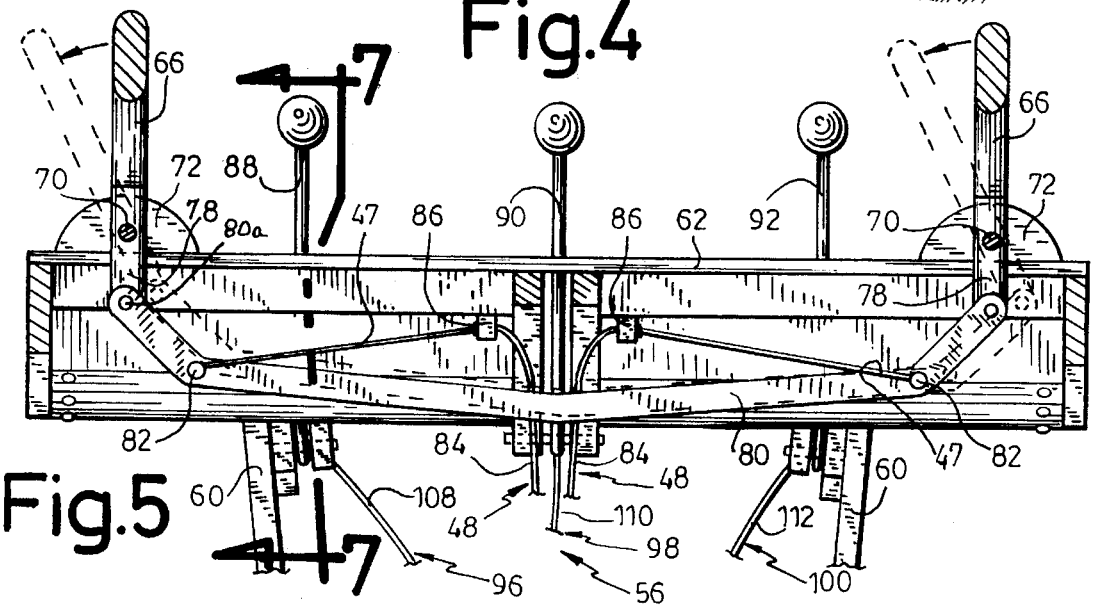
Fig.5

STEERABLE TOY ROAD SCRAPER

FIELD OF THE INVENTION

This invention relates to a toy vehicle, and more particularly to a cable-operated steerable toy road grader and loader.

BACKGROUND OF THE INVENTION

Toy vehicles, such as road scrapers and other such vehicles, often have the disadvantage of forcing the child playing with it to kneel or bend down due to the small size of the toy. Thus the displacement of the child with the toy is slow, since he cannot walk normally with his toy, and he is prone to injury on his knees on the ground.

Some toys were designed to allow the child playing with it to stand while using his toy. These toys are usually relatively large in size, though one or more control handles extending upwardly from the toy are often used to control the displacements of the toy.

Such a toy is shown in U.S. Pat. No. 3,308,573 issued in 1967 to J. W. Ryan. A skip loader toy comprises an upwardly-extending elongated handle at the upper free end of which is fixedly installed a handle grip for moving skip loader and a first and a second pivoted control levers for controlling the scoop, through the instrumentality of a first and a second link bar. The length and slope of handle allow the child to stand while moving and/or operating toy. One problem with this toy is that the link bars are prone to be more or less bent during the use of the toy. Indeed, the likelihood of an impact of the toy with an extremely hard surface at high speed during the use of the toy by one or more children is high, as so many parents have discovered. Also, if the weight which is to be lifted by scoop is too great, the bending moment in bars may be important enough to bend bars. The bending of the link bars will hamper or prevent their use, therefore rendering the toy inoperable.

U.S. Pat. No. 2,782,554 issued in 1957 to H. Muller shows a toy grab comprising an inner wire enclosed in an enclosing tubular helix, with which the operation of the grab is possible by pressing simultaneously in opposite directions on a finger pressure plate and on a push button. This wire, of course, cannot be significantly affected by impact-resulting bending moments. However, the push button and pressure plate force the user to keep pressure on them to leave the grab jaws open, because of coil springs forcing the jaws into a closed position. Therefore, the hand need always hold the push button and pressure plate of the grab when the latter is to be used, which is undesirable. Indeed, were the Muller grab installed on a moving toy truck, it would be impossible to use it while moving the truck.

OBJECTS OF THE INVENTION

The gist of the invention is to enable children to push and handle their vehicle toys such as graders, loaders, trucks, scrapers, etc . . . without having to kneel or to crouch.

It is an object of this invention to provide a toy vehicle that has cable-operated mechanisms usable by the user in a standing position.

SUMMARY OF THE INVENTION

The present invention is a steerable toy vehicle comprising an elongated frame, front and rear pairs of wheel assemblies supporting the vehicle frame over ground with said front wheel assembly being steerable, and at least one blade member mounted to said vehicle frame for relative movement between a ground engaging limit position and a raised limit position;

wherein said vehicle further includes a control panel, supported spacedly over the rear end of the vehicle frame by an elongated upwardly rearwardly extending support arm member integrally mounted to the vehicle frame, said control panel adapted to be at a sufficiently raised height to provide arm's length access thereto by a person standing up, said control panel operatively carrying:

(a) a steering handle assembly, operatively connected to said steerable front wheels by first flexible cable means for steering same upon lateral tilting of the handle assembly, and destined to be grasped manually by a person and pushed for moving the vehicle forwardly; and (b) at least one lever member, operatively connected to a corresponding said blade member by second flexible cable means, for displacing same between its two limit positions.

Preferably, the steerable toy vehicle further includes locking means, to releasably lock said lever member in a position to hold said blade member in said raised limit position against the weight bias thereof.

The invention also relates to a steerable toy vehicle comprising an elongated frame, front and rear pairs of wheel assemblies supporting the vehicle frame over ground with said front wheel assembly being steerable, a loader member mounted to the front end of said vehicle frame for relative movement between a ground engaging limit position and a raised limit position, a grader blade mounted transversely to an intermediate section of said vehicle frame therebeneath for relative movement between a ground engaging limit position and a raised limit position, and a shovel blade mounted to said vehicle frame intermediately between said grader blade and said rear wheels axle for relative movement between a ground engaging limit position and a raised limit position;

wherein said vehicle further includes a control panel, supported spacedly over the rear end of the vehicle frame by upwardly rearwardly extending support arms integral to the vehicle frame, said control panel adapted to be at a sufficiently raised height to provide arm's length access thereto by a person standing up, said control panel operatively carrying:

(a) a steering handle assembly, operatively connected to said steerable front wheels by first cable means for steering same upon lateral tilting of the handle assembly, and destined to be grasped manually by a person and pushed for moving the vehicle forwardly;

(b) a first handle member, operatively connected to said front loader member by first flexible cable means, for displacing same between its two limit positions;

(c) a second handle member, operatively connected to said intermediate grader blade by second flexible cable means, for displacing same between its two limit positions; and (d) a third handle member, operatively connected to said shovel blade by third flexible cable means, for displacing same between its two limit positions.

Preferably, this steerable toy vehicle further includes control means for varying the angular orientation of said transverse grader blade relative to the longitudinal axis of the elongated vehicle.

Alternately, the steerable toy vehicle of the invention comprises:

a) a main rigid frame carried over ground by a set of front and rear wheels;

b) a directional system selectively acting on said front wheels for steering said toy vehicle;

c) operational means;

d) control means;

e) at least one directional flexible cable member attached to said directional system; and f) at least one operational flexible cable member attached to said operational means; said directional and operational cable members being linked to said control means and being selectively biased into a linear displacement thereby, consequently adjusting accordingly said directional system into a selected stable position and said operational means into a selected one of two stable limit positions.

Advantageously, the toy vehicle further comprises an upwardly-extending arm member and a control panel attached thereto, at the upper end thereof, said control means being installed on said control panel.

Preferably said operational means defines several working devices that are each linked by at least one of said operational cable members to said control means.

Advantageously, said operational and directional cable members each comprises an inner cable enclosed in a fixed flexible sheathing for a sliding engagement therein.

Preferably, at least one of said working devices is a blade member for use in scraping a road.

In a preferred embodiment of the invention, said operational means comprises three working devices, namely a first, a second and a third blade member, said first, second and third blade members being vertically movable and selectively adjusted in either a first or a second respective stable limit position with respective operational cable members and said second blade member being also angularly movable between a first and a second limit position.

Preferably, said control means comprises two directional handles pivotally attached to said control panel and linked to said two directional cable members, the linear displacement of said two directional cable members being selectively adjusted by the pivoting movement of said directional handles.

Alternately, said control means comprises two directional handles rotatably attached to said control panel and linked to said two directional cable members, the linear displacement of said two directional cable members being selectively adjusted by the rotating movement of said directional handles.

DESCRIPTION OF THE DRAWINGS

In the annexed drawings:

FIG. 3 is a top plan view of the front wheel set and directional system of the road scraper of the invention;

FIG. 4 is a partial cross-sectional view, at an enlarged scale, taken along line 4—4 of FIG. 2, suggesting in dotted lines an alternate position for the front blade member;

FIG. 5 is a partial cross-sectional view, at an enlarged scale, taken along line 5—5 of FIG. 2;

DETAILED DESCRIPTION OF THE EMBODIMENTS

Figures 1, 6:
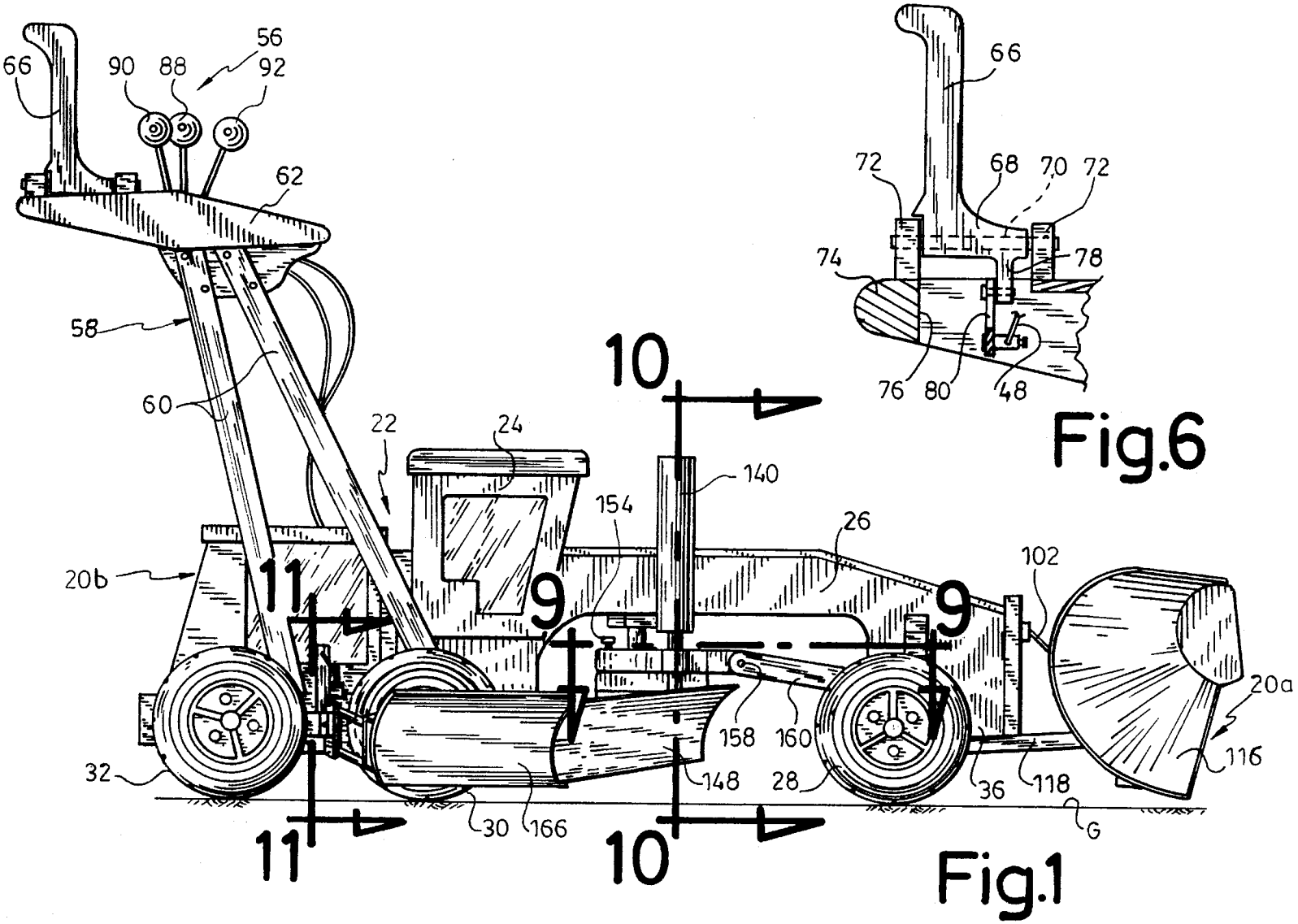
FIG. 1 is a side elevation of a preferred embodiment of the road scraper according to the invention.
FIG. 6 is a partial cross-sectional view, at an enlarged scale, taken along line 6—6 of FIG. 2.
Figure 2:
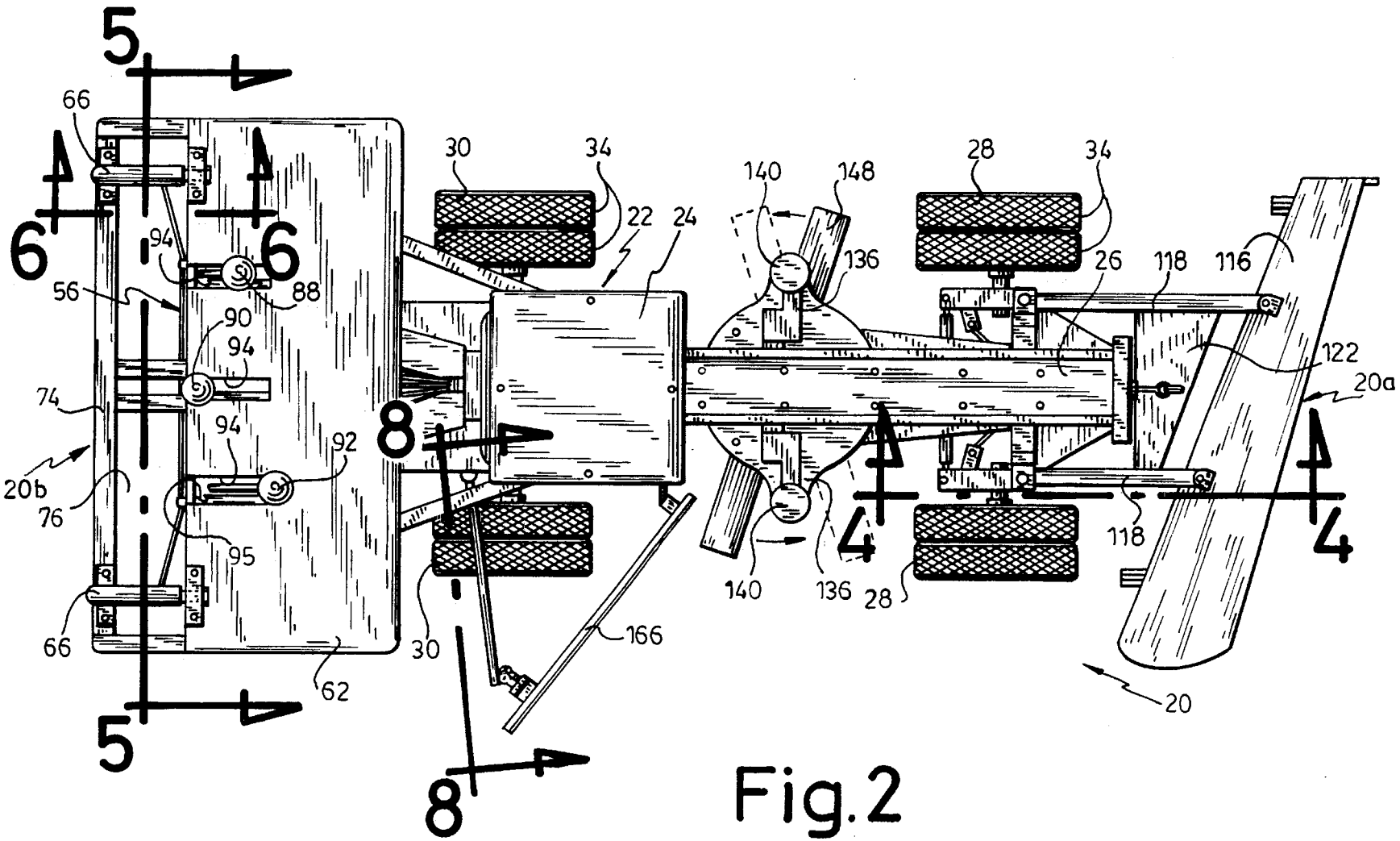
FIG. 2 is a top plan view of the road scraper of FIG. 1.

A first embodiment of the invention is shown in FIGS. 1 to 11. FIGS. 1 and 2 show a toy vehicle, and more specifically a toy road scraper 20 defining a front and a rear end **20*a* and 20*b* and having a hollow main body 22**.

Main body 22 has the conventional shape of a road scraper and defines a central longitudinal axis. There is a hollow mock driver's cabin 24 mounted intermediately of body 22 and an elongated beam 26, generally rectangular in cross-section, extends frontwardly therefrom. Body 22 is carried by the axles of three pairs of wheels, namely a pair of front wheels 28, 28, a pair of rear wheels 32, 32 and a pair of intermediate wheels 30, 30. Each wheel has two tires 34, 34 which rest on ground G. Intermediate wheels 30, 30 and rear wheels 32, 32 are axially aligned with one another by pairs, while front wheels 28, 28 are always axially parallel and may be axially aligned.

A directional system 35, shown in FIG. 3, allows to "drive" toy 20 in the desired direction. Indeed, directional system 35 allows the angular displacement, relative to a vertical plane, of the front wheels 28, 28 to be selectively adjusted. The pair of front wheels 28, 28 is positioned at the front end **20*a* of scraper 20, under a downwardly projecting nose 36 of beam 26. Each front wheel 28 has an axle 38 on which it can freely rotate, axle 38 perpendicularly and fixedly engaging an elongated axle support 40 in its intermediate portion. Each axle support 40 is pivotally attached at its extremities to the respective extremities of a first and second parallel rigid link bar 42, 44 which rigidly but pivotally link both axle supports 40, 40 in a parallel fashion. Axle supports 40, 40 and link bars 42, 44 thus form a parallelogram jointed at its four corners. Second link bar 44 is located towards rear end 20*b* of scraper 20, relative to first link bar 42, and is fixedly anchored at its intermediate portion to nose 36 of beam 26. Each axle support 40 carries a transverse ear 46 fixedly attached thereto, between axle 38 and link bar 42, which protrudes from its inner face, generally facing the central longitudinal axis. Each ear 46 includes an outer end eyelet to fixedly attach thereon the inner cable 47 of a directional cable member 48. The two cables 47, 47 of directional cable members 48, 48 are oriented in a convergent fashion towards the central longitudinal axis of main body 22 and the nose 36 of beam 26, being each inserted into a bore (not shown) on the corresponding side of beam 26, engaging a pulley 50 therein and being redirected along and inside hollow beam 26 towards the rear end 20***b* of road scraper 20.

In use, when one of the two directional inner cables 47 is pulled towards rear end 20*b* of scraper 20, it will pivot axle support 40 and the angular displacement, relative to a vertical plane, of wheels 28, 28 can thus be adjusted. Indeed, due to the movable rigid link bar 42 which constrains the frontward extremities of both axle supports 40, 40 to a same angular displacement, the orientation of front wheels 28, 28 is adjustable by cables 47, 47. When one directional inner cable 47 is pulled towards rear end 20*b*, the other is pulled towards front end 20*a* of scraper 20, as suggested by arrows 52 and 54 on FIG. 3.

FIGS. 1, 2 and 5 show that control means 56 are located at rear end 20*b* of toy road scraper 20, at the upper extremity of an upwardly and rearwardly extending arm member 58. Arm member 58 comprises in this case four support bars 60 which not only extend upwardly but are also slightly rearwardly inclined, so as to allow a child having his hands on control means 56 to walk behind scraper 20 without main body 22 hindering his steps. Support bars 60 are fixedly attached at their lower end to main body 22.

Control means 56 rests on a control panel 62, which is fixedly anchored to the upper end of arm member 58. Control panel 62 has a generally rectangular shape in top plan view and defines a hollow inner chamber. Control means 56 comprises a pair of directional handles 66, 66 (FIGS. 1, 5 and 6) correctly shaped to conform to the interior surface of a hand. Handles 66 are pivotally attached on the upper surface of control panel 62, as shown in FIGS. 5 and 6. Indeed, each handle 66 has an integral cylindrical bored base 68 engaged by a small pivot rod 70 which is supported at both its extremities by small rod supports 72, 72, so that base 68 may spacedly hang over the level of the top surface of control panel 62. As shown in FIG. 2, a rear propelling handle 74 is fixedly and spacedly attached to the rear end of control panel 62, thus defining a rectangular opening 76 between propelling handle 74 and control panel 62, in which the fingers of the hands may be inserted to grip handle 74 more firmly to propel scraper 20. Directional handles 66 hang over opening 76, and a short integral finger 78 downwardly projects from base 68 between propelling handle 74 and control panel 62 (FIG. 6). Finger 78 can thus longitudinally pivot in opening 76.

A substantially widened V-shaped link member 80 is pivotally mounted at 80*a* at its legs top ends to the lower extremity of fingers 78, 78, for pivotal motion about a horizontal axis, so that both directional handles 66 are constrained in a simultaneous pivoting movement, this movement transversely translating link member 80, as suggested in dotted lines in FIG. 5. Directional inner cables 47, 47 are attached to the intermediate portion of V-shaped link member 80 at attachment points 82, 82, link member 80 being mostly horizontal from its geometrical center up to the attachment points 82, 82 of cable members 48, 48, then sloping upward in a more inclined fashion to fingers 78, 78. When directional handles 66, 66 are pivoted or tilted sideways, link member 80 is correspondingly translated and pulls on one of the two cables 47, 47 of directional cables 48, 48. This way, the orientation of front wheels 28, 28 can be selectively adjusted through directional handles 66 by tilting them one way or the other.

Each cable member 48 defines an inner cable 47 enclosed in a fixed flexible sheathing 84 for a sliding engagement therein (FIG. 5). Cable 47 is oriented from finger 78 towards the body 22 central longitudinal axis and inserted into sheathing 84 at a vehicle chassis mounted cable support 86, where directional cable member 48 is downwardly oriented to pass through main body 22 and beam 26 up to directional system 35. Sheathing 84 extends up to a position inside main body 22 or beam 26 and is also fixed at its second extremity (not shown).

Figure 7:
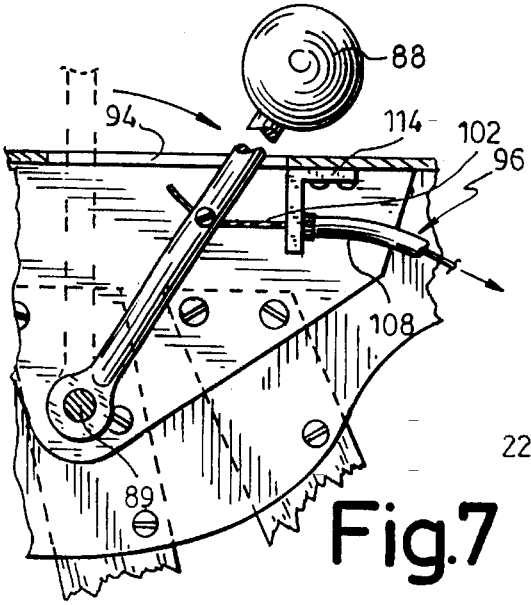
FIG. 7 is a cross-sectional view, at an enlarged scale, taken along line 7—7 of FIG. 5.
Figure 8:
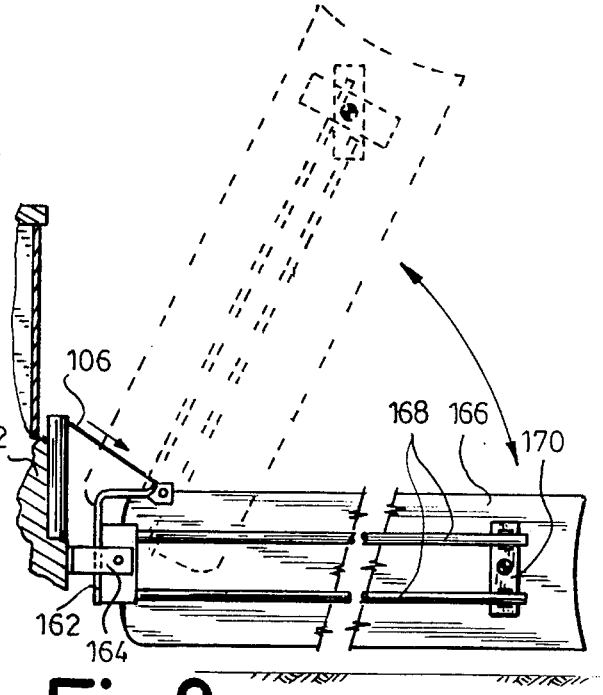
FIG. 8 is a partial cross-sectional view, at an enlarged scale, taken along line 8—8 of FIG. 2, suggesting in dotted lines a second position for the side blade member.
Figure 10:
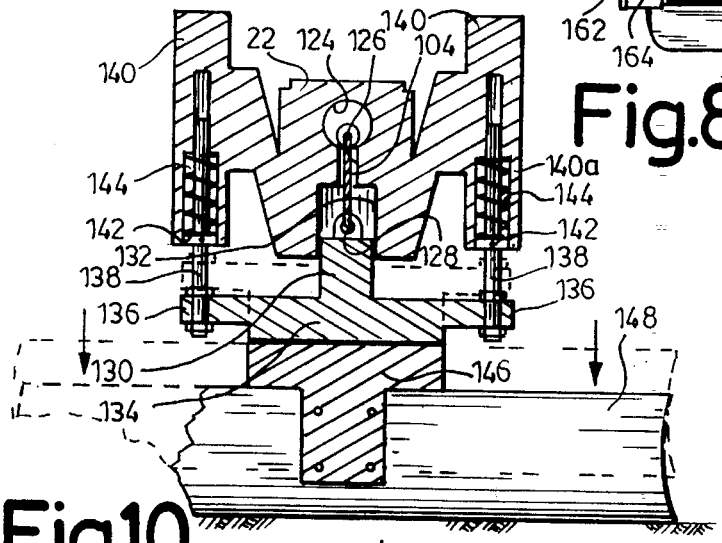
FIG. 10 is a partial cross-sectional view, at an enlarged scale, taken along line 10—10 of FIG. 1.

FIGS. 2 and 7 also show that control means 56 further defines a first, a second and a third upright lever members 88, 90, 92 each pivotally mounted at its bottom end to a horizontal pivot axle 89, and movable along a horizontal longitudinal slot 94 in control panel 62 between a first and a second limit position. Each slot 94 includes a transverse stop notch 95 (FIG. 2) at its rear end to releasably lock handle 88, 90 and 92. In FIG. 2, handle 90 is engaged in its stop notch 95. As shown in full lines in FIG. 7, the first limit position of the latter is defined by the frontward abutment of lever members 88, 90, 92 on control panel 62, while the second limit position is shown by the dotted lines in FIG. 7. A first, a second and a third operational cable member 96, 98, 100 are attached to each respective lever member 88, 90, 92. As shown in FIGS. 7, 8 and 10, each operational cable member 96, 98, 100 comprises an inner cable 102, 104, 106 enclosed in a fixed flexible sheathing 108, 110, 112 for sliding engagement therein. Sheathings 108, 110, 112 are fixedly attached to control panel 62 by means of L-shaped attachment plates 114 (FIG. 7). Cables 102, 104, 106 are attached at one extremity to their respective lever member 88, 90, 92 and are inserted into their respective sheathing 108, 110, 112. Therefore, when one of the lever members 88, 90, 92 is pivoted, the corresponding cable 102, 104, 106 is biased into a linear displacement and guided by its sheathing 108, 110, 112, as suggested in FIG. 7 in dotted lines.

FIGS. 1, 2 and 4 show that inner cable 102 of first operational cable member 88 is linked to a concave front blade member 116 which is fixed at the frontward end of blade support arms 118, 118, the latter being pivotally fixed on the sides of nose 36 so as to be vertically pivotable relative to main body 22 between a first ground-engaging and a second ground-clearing limit position, as suggested in dotted lines in FIG. 4. Cable 102 extends out from a bore on the front face of nose 36, and is fixedly attached to an ear 120 fixedly anchored to a plate 122 bridging both blade support arms 118, 118 and fixed thereto.

In use, as shown in FIG. 4, when first lever member 88 is pulled from its first to its second limit position, it pulls on cable 102 of first cable member 88 and raises front blade member 116 from its first to its second limit position, and vice-versa. To keep front blade member 116 from falling from its second raised to its first lowered position when first lever member 88 is released, lever member 88 can be laterally inserted into its stop notch 95 so as to prevent any linear movement of cable 102, and consequently prevent front blade member 116 from falling under its own weight. To rest front blade member 116 on ground G, first lever member 88 is slightly pulled back and laterally moved to clear stop notch 95, and then the gravity force will take front blade member 116 to rest upon ground G (first limit position).

FIG. 10 shows that cable 104 of second operational cable member 98 extends from a lumen 124 through an aperture 126 in chassis 22 to engage an ear 128 fixedly anchored on a main piston 130 which is axially guided inside a vertical sleeve 132 cut into the hollow of beam 26 of scraper 20. Piston 130 coaxially projects upwardly from an integral cylindrical disc 134 which is vertically movable between a first and a second limit position. Disc 134 has two laterally-protruding wings 136 from which upwardly project two fixedly anchored lateral pistons 138, 138 up into respective lateral sleeves 140, 140 in which they can move vertically up to the maximum height of sleeves 140, 140 and down to the vertical limit position determined by abutment rings 142, 142. Springs 144, 144, located in enlarged intermediate chambers 140*a*, 140*a* of sleeves 140, 140, downwardly bias cylindrical disc 134 by acting on abutment rings 142, 142. A revolving disc 146 is rotatably and coaxially installed adjacent to and under cylindrical disc 134. A concave center blade member 148 is fixed thereto and generally faces towards front end 20*a* of scraper 20, its bottom edge being positioned lower than revolving disc 146 to freely engage ground G.

Figure 9:
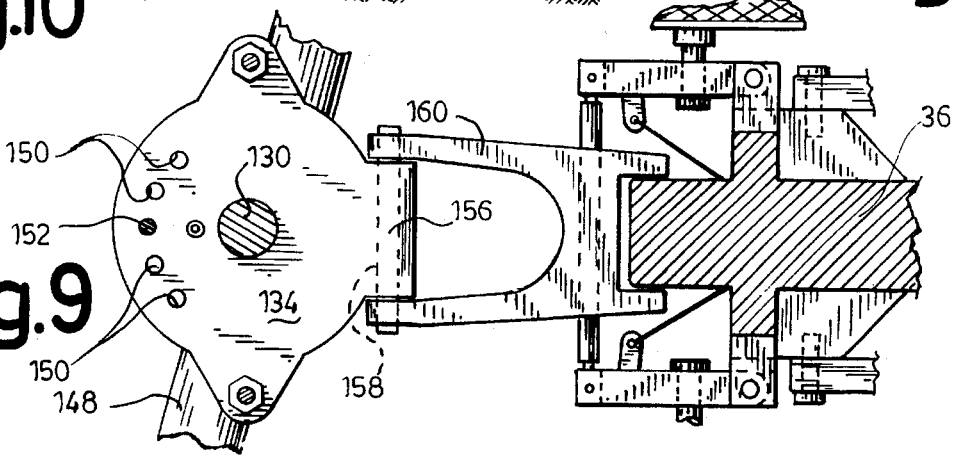
FIG. 9 is a partial cross-sectional view, at an enlarged scale, taken along line 9—9 of FIG. 1.
Figure 12:
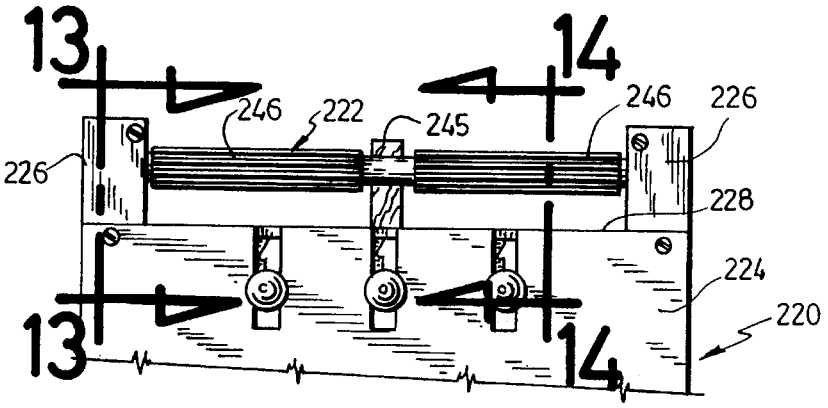
FIG. 12 is a top plan view of another embodiment of the propelling and directional handles of the road scraper.

As seen in FIG. 9, revolving disc 146 and consequently center blade member 148 can be selectively oriented in any of five directions, all of them facing generally towards front end 20*a* of scraper 20. Indeed, fixed cylindrical disc 134 is bored at five different places along an arc spaced from and coaxial to the peripheral edge of cylindrical disc 134. A selected one of these five bores 150 is engaged by a threaded rod 152 fixed to revolving disc 146 and which is to be secured in place by a nut 154 (FIG. 1). Therefore, to choose the orientation of center blade member 148, rod 152 must be inserted into the desired one of the five bores 150 and bolted thereto.

In use, once the orientation of center blade member 148 is determined, it can be vertically positioned either in a first ground-engaging or in a second ground-clearing limit position. Indeed, moving second lever member 90 from its first to its second limit position results in imparting a linear displacement to cable 104 of corresponding second operational cable member 98, and cable 104 raises cylindrical disc 134 and consequently center blade member 148. Again, by laterally inserting lever member 90 into laterally offset stop notch 95 of raised platform 62, center blade member 148 may be kept at its raised second limit position, against the bias of its own weight, and by releasing lever member 90 from stop notch 95, center blade member 148 is lowered to ground level (first limit position).

FIGS. 1 and 9 show that cylindrical disc 134 has a frontward bored extension 156 axially engaged in a pivoting relationship by the rod 158 of a generally U-shaped reinforcement member 160 which is pivotally attached at the rear end of nose 36. Reinforcement member 160 retains cylindrical disc 134 along the longitudinal axis of scraper 20, thus preventing the breakage of certain parts due to an important force applied on center blade member 148, particularly the bending of pistons 130, 138, 138 (FIG. 10). This may result, for example, from a load of earth being carried by center blade member 148. The fact that reinforcement member may pivot relative to nose 36 and cylindrical disc 134 allows center blade member 148 to be raised and lowered freely without being hindered by reinforcement member 160.

Figure 11:
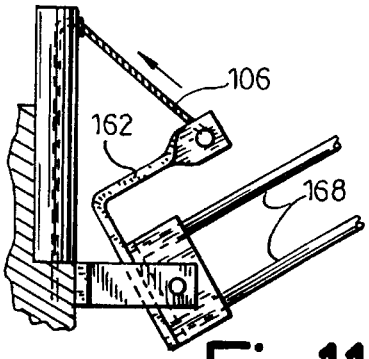
FIG. 11 is a partial cross-sectional view, at an enlarged scale, taken along line 11—11 of FIG. 1.

FIGS. 8 and 11 show that cable 106 of third operational cable member 100 extends through a bore (not shown) in the side of the vehicle main body 22 and slopes downwardly to an L-shaped arm 162. Arm 162 has an integral anchoring member 164 to which is pivotally anchored a concave side blade member 166, by means of a pair of horizontal attachment bars 168, 168 extending outwardly, relative to scraper 20. Attachment bars 168, 168 are also pivotally attached to a pivoting plate 170 at their outer extremity. Thus, as suggested in dotted lines in FIG. 8, side blade member 166 is pivotally movable between a first lowered and a second raised angular limit position. When cable 106 of third operational cable member 100 is pulled, it pivots arm 162 and consequently side blade member 166 is raised from its first to its second limit position. This is accomplished by moving third lever member 92 from its first to its second limit position. By laterally inserting third lever member 92 in its laterally offset corresponding stop notch 95, it is possible to release third lever member 92 without side blade member 166 falling to its first position. Again, to release side blade member 166, third lever member 92 must be laterally moved to clear stop notch 95 and the gravity force will allow lever 92 to slide forwardly along platform slot 94 to concurrently lower side blade member 166 under its own weight.

The first lowered position of blade members 116, 148 and 166 is a ground-engaging position that allows toy road scraper 20 to channel the snow or earth (or any other granular material) away from the engaged surface.

Toy road scraper 20 can therefore be guided and controlled by a child standing behind the rear end 20*b*, without hindering the walking movements of the child and permitting him to control the position of the blade members by means of several cable members which are not prone to bending or premature breakage. Concerning this last aspect, the operational and directional cable members are located between the support bars 60 of arm member 58, so that it is less likely that they be damaged during the use of the toy road scraper.

The three blade members 116, 148, 166 are the operational means of toy road scraper 20. It is understood, however, that the operational means could include any additional number of such blade members, and also different working devices such as grabs or scoops (shovels) or other related members, as long as the toy vehicle remains manually operable. In any case, within the scope of the invention, such devices would also operate by means of levers connected to corresponding operational cable members which would permit to move the working device from a first to a second limit position. There could also be only one such working device, such as a single scoop at the front end. In any event, there is one operational cable member associated with each function of the toy vehicle.

FIGS. 12 to 16 show a second embodiment of the invention. The toy road scraper 220 is very similar to the toy road scraper 20 of the first embodiment, except for its handle member 222. Scraper 220 defines a control panel 224 having two fixed, spaced, rearwardly-projecting supports 226, 226 between which is rotatably installed cylindrical handle member 222. The latter can rotate around its axis, and is spaced from control panel 224, thus defining an opening 228 which allows fingers to be inserted therein, for a better grip on handle member 222.

The first purpose of handle member 222 is to allow a good grip to move scraper 220, as propelling handle 74 in the first embodiment.

Figure 13:
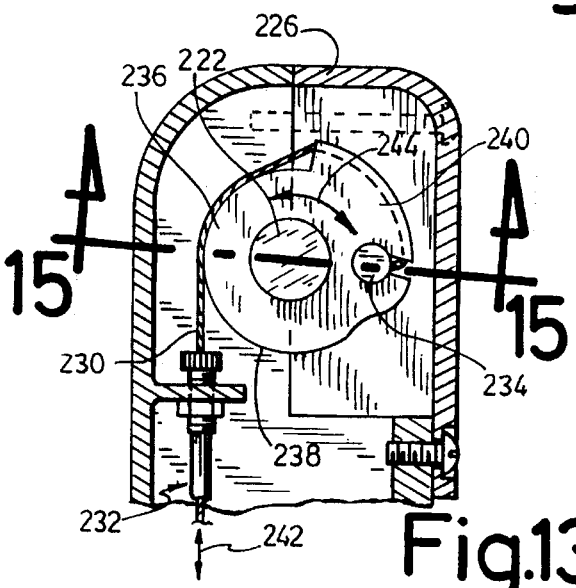
FIG. 13 is a cross-sectional view, at an enlarged scale, taken along line 13—13 of FIG. 12.
Figure 15:
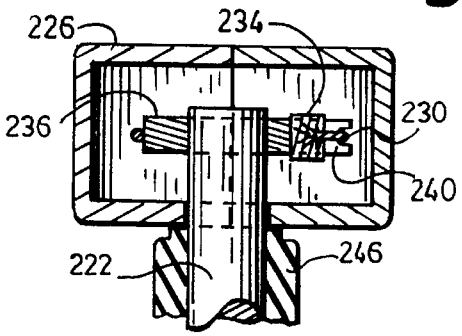
FIG. 15 is a cross-sectional view taken along line 15—15 of FIG. 13.

The second purpose of handle member 222 is to steer scraper 220. Indeed, as shown in FIGS. 13 and 15, the extremity of each one of the two inner cables 230, 230 of the directional cable members 232, 232 of scraper 220 is fixedly attached by a stopper 234 to a coaxial ring 236 fixedly and coaxially installed at the extremity of handle member 222 protruding inside a corresponding one of hollow supports 226. Ring 236 defines a relatively flat peripheral surface 238 on a sector portion of which cable 230 may rests. Cable 230 also rests on an arcuate radially-grooved guiding member 240 coaxial and integral to ring 236 to prevent it from sliding off peripheral surface 238.

In use, if handle member 222 is rotated in one direction or another, it will wind up or unwind inner cables 230, 230 and consequently impart them a linear displacement, as suggested by arrows 242, 244 in FIG. 13. The result is therefore the same as in the first embodiment of the invention, but the directional handle and the propelling handle have been merged into a single handle member 222 that permits both to handle and to steer toy road scraper 220.

Figure 14:
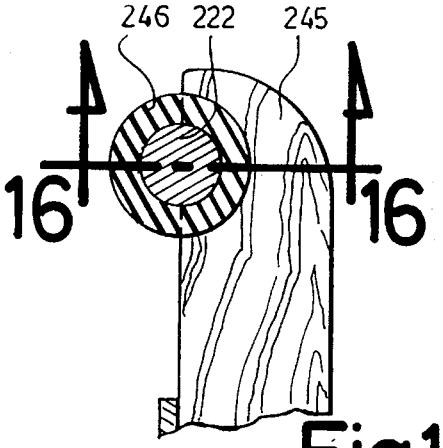
FIG. 14 is a cross-sectional view, at an enlarged scale, taken along line 14—14 of FIG. 12.
Figure 16:
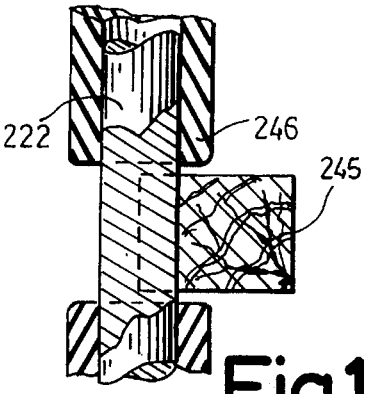
FIG. 16 is a cross-sectional view, taken along line 16—16 of FIG. 14.

FIGS. 14 and 16 show that an abutment bar 245, fixedly attached to control panel 224, has a semi-circular opening in which handle member 222 is positioned. Abutment bar 245 is located midway between the two supports 226. This way, when pushing road scraper 220 forward (and possibly a load of snow or earth), handle member 222 will be less likely to bend since it abuts near its center on abutment bar 245.

Handle member 222 is advantageously made of a hard and non-elastic material, such as a metal, to prevent the bending or breakage of handle member 222.

Preferably, as shown in FIGS. 14 and 16, handle member 222 is covered with two liners 246 which cover its whole length on one side and the other of abutment bar 245 and between the two supports 226, for the comfort of the user.

It is understood that, in both embodiments, only a single directional cable member could be used instead of two, either with a single directional handle or with two of them, the directional cable member then being U-shaped to link both the axle supports together with the two handles.

The invention therefore consists of a guiding push bar fixedly anchored to the rear of the toy vehicle. Control levers mounted to the bar are connected to accessories such as a lift bucket, a tip bucket, a grader, a front scraper, a side scraper, etc . . . via control cables. These control cables are preferably brake cables used for bicycles, or pneumatic or hydraulic system hoses, enabling to guide the front wheels and to operate the accessories of the toy. This concept enable the child to operate the vehicle by operating the guiding bar, by pushing and controlling the front wheels and to operate mechanically, electrically or pneumatically all the accessories. Preferably, the height of the vehicle varies between 20 and 42 inches, which allows the child to walk or run with the toy in upstanding position. Comfort of the user is enhanced, for use over snow, sand, on turf or on asphalt, or even in shallow waters.

In the present invention, a reference to a vertical direction implies that the toy road scraper is resting on a horizontal surface.

I claim:

1. A steerable toy vehicle comprising:

a) a rigid elongated frame;

b) a set of front and rear wheels rotatably mounted to said frame for carrying it spacedly over ground;

c) control means installed at the upper end of an upwardly-extending arm member, said arm member being fixedly attached to said frame;

d) a first, a second and a third blade members attached to said frame member and being vertically movable thereon between respective first and second stable limit positions;

e) a number of first flexible cable members linking said control means to said first, second and third blade members for selectively positioning said first, second and third blade members into their respective first or second stable limit positions; and f) a second flexible cable member linking said control means to said set of front wheels for selectively pivoting said set of front wheels and consequently steering said toy vehicle with said control means.

2. A toy vehicle as defined in claim 1, wherein said first cable members further link said control means to said second blade member for selective angular adjustment of said second blade member between a first and a second angular limit positions.

3. A toy vehicle as defined in claim 1, wherein said first and second cable members each comprise an inner cable enclosed in and slidingly engaging a fixed flexible shearing.

4. A steerable toy vehicle comprising an elongated frame having a front and a rear end, said toy vehicle further comprising front and rear pairs of wheel assemblies supporting said frame over ground with said front wheel assembly being steerable, a loader member mounted to the front end of said vehicle frame for relative movement between a ground engaging limit position and a raised limit position, a grader blade mounted transversely to an intermediate section of said vehicle frame therebeneath for relative movement between a ground engaging limit position and a raised limit position, and a shovel blade mounted to said vehicle frame intermediately between said grader blade and said rear wheel assembly for relative movement between a ground engaging limit position and a raised limit position; wherein said vehicle further includes a control panel, supported spacedly over the rear end of the vehicle frame by upwardly rearwardly extending support arms integral to the vehicle frame, said control panel adapted to be at a sufficiently raised height to provide arm's length access thereto by a person standing up, said control panel operatively carrying:

(a) a steering handle assembly, operatively connected to said steerable front wheels by first cable means for steering same upon lateral tilting of the handle assembly, and destined to be grasped manually by a person and pushed for moving the vehicle forwardly;

(b) a first handle member, operatively connected to said front loader member by first flexible cable means, for displacing said front loader member between its two limit positions;

(c) a second handle member, operatively connected to said intermediate grader blade by second flexible cable means, for displacing said intermediate grader blade between its two limit positions; and (d) a third handle member, operatively connected to said shovel blade by third flexible cable means, for displacing said shovel blade between its two limit positions.

5. A steerable toy vehicle as in claim 4, further including control means, said transverse grader blade being selectively rotatable around a vertical axis between a first and a second angular limit positions through the instrumentality of said control means.

* * * * *